US005330197A

United States Patent [19]

Bair

[11] Patent Number: 5,330,197

[45] Date of Patent: Jul. 19, 1994

[54] GAME BOARD

[76] Inventor: Willard E. Bair, 6802 E. 78th St., Tulsa, Okla. 74133-3465

[21] Appl. No.: 17,507

[22] Filed: Feb. 11, 1993

[51] Int. Cl.[5] ..... A63F 3/00

[52] U.S. Cl. ..... 273/285; 273/287

[58] Field of Search ..... 273/285, 287, 272, 241

[56] References Cited

U.S. PATENT DOCUMENTS 4,185,834 1/1980 Mozzi et al. ..... 273/241

FOREIGN PATENT DOCUMENTS 413297 3/1909 France ..... 273/285

OTHER PUBLICATIONS

"Balance", Present Games LTD., 1987.

*Primary Examiner*—Benjamin H. Layno

*Attorney, Agent, or Firm*—Catalano, Zingerman & McKay

[57] ABSTRACT

A folding game board is provided which consists of a unitary thin plastic member divided into segments by at least one pair of parallel grooves having nadirs separated by a zenith. Each folding segment has one or more ridges on its face, preferably at least two of them in non-parallel planes perpendicular to the face, and a main body or segment of the board having corresponding ridges defining surfaces in non-parallel planes perpendicular to the face, non-parallel planes being aligned so that the mating ridge surfaces provide a frictional interface therebetween when the segments are folded at the nadirs into juxtaposition with the main body of the board. Preferably, one of the nadirs will be shallower than the other of the nadirs so as to increase the force exerted by the folding junction to maximize the frictional normal force. In its preferred embodiment, the game board will be square and the folds will define equal right isosceles corners about the square which symmetrically fold toward the center of the square.

9 Claims, 2 Drawing Sheets

GAME BOARD

BACKGROUND OF THE INVENTION

This invention relates generally to board games and more particularly concerns game boards which fold from a playing configuration to a smaller storage configuration.

Presently known folding game boards typically consist of a plurality of cardboard panels which fold along paper seams connecting the panels together. Particularly with respect to games played by younger children, the forces exerted on the panels eventually result in the separation of the seaming material from the board or the tearing of the material along the seam. Even in the exercise of careful use of a board, repetitive folding and unfolding causes the seaming material to crease and eventually to split a process which, once begun, results in rapid deterioration across the entire seam.

The use of a non-folding board is not a satisfactory solution to this problem since the box containing the game must then be two and even four times its otherwise necessary size in order to accommodate the board. This increases the cost of the game to the consumer as well as shelf space to both the consumer and the retailer.

It is, therefore, an object of this invention to provide a folding game board in which the folding edges of the board will not deteriorate as a result of repetitive folding and unfolding. A similar object of this invention is to provide a game board having folding edges which will not deteriorate or separate despite external forces applied to the board which reasonably exceed the forces normally anticipated in its use. Another object of this invention is to provide a folding game board which is of unitary or integral construction. A further object of this invention is to provide a folding game board made of a single piece of plastic. And it is an object of this invention to provide a folding game board which friction locks in its folded condition.

SUMMARY OF THE INVENTION

In accordance with the invention a folding game board is provided which consists of a unitary thin plastic member divided into segments by at least one pair of parallel grooves having nadirs separated by a zenith. Each folding segment has one or more ridges on its face, preferably at least two of them in non-parallel planes perpendicular to the face, and a main body or segment of the board having corresponding ridges defining surfaces in non-parallel planes perpendicular to the face, non-parallel planes being aligned so that the mating ridge surfaces provide a frictional interface therebetween when the segments are folded at the nadirs into juxtaposition with the main body of the board. Preferably, one of the nadirs will be shallower than the other of the nadirs so as to increase the force exerted by the folding junction to maximize the frictional normal force. In its preferred embodiment, the game board will be square and the folds will define equal right isosceles corners about the square which symmetrically fold toward the center of the square.

BRIEF DESCRIPTION OF THE DRAWINGS:

Other objects and advantages of the invention will become apparent upon reading the following detailed description and upon reference to the drawings in which.

Figure 3:
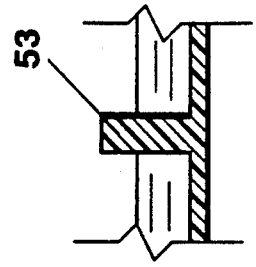
FIG. 3 is a cross-sectional view taken along the line 3—3 of FIG. 1.
Figure 1:
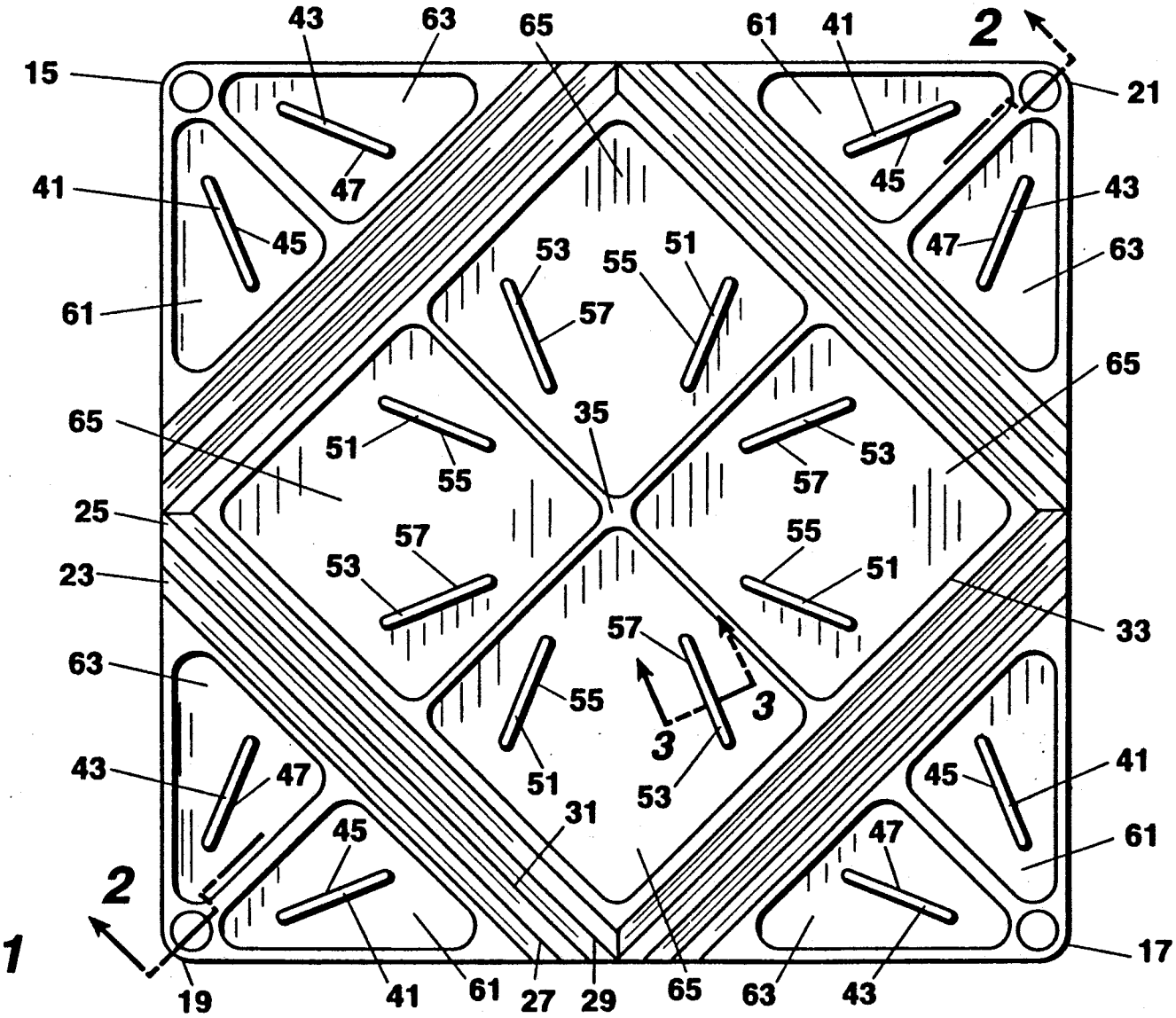
FIG. 1 is a bottom plan view of a preferred embodiment of a folding game board.
Figure 2:
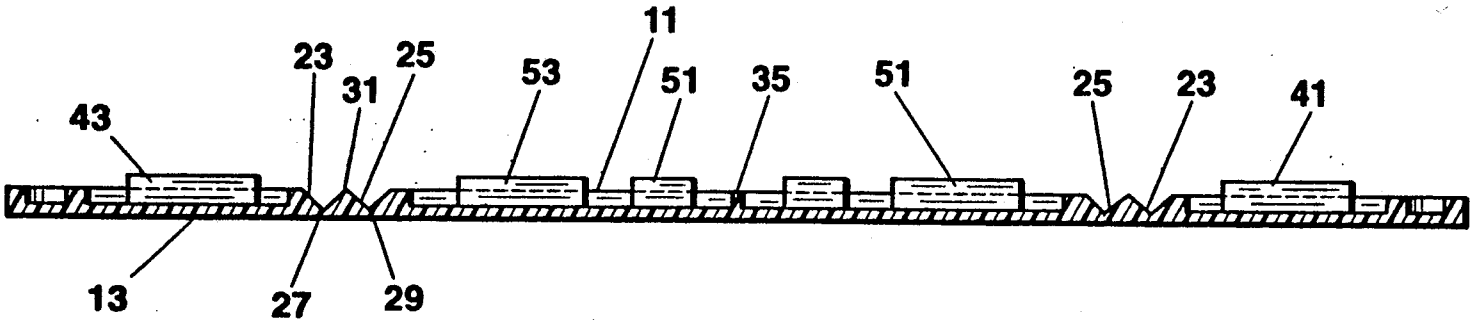
FIG. 2 is a cross-sectional view taken along the line 2—2 of FIG. 1.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

A preferred embodiment of the folding game board is illustrated in the Figures. The embodiment shown is for a square board formed from a unitary thin plastic member having a top face 11 and a bottom face 13. It should be noted that the bottom face 13 will constitute the game board playing surface, the game board being displayed in the figures in an inverted condition so as to illustrate the irregular contour of the non-playing surface or top face 11. In this preferred embodiment, the board is shown to be square having upper, lower, left and right corners 15, 17, 19 and 21, respectively. The game board may, however, be of any desirable planar configuration.

In order to permit folding of the game board into a smaller configuration, at least one pair of parallel grooves 23 and 25 having nadirs 27 and 29, respectively, separated by a zenith 31, extends across the top face 11, dividing the game board into segments. As shown in the preferred embodiment, four pairs of such parallel grooves 23 and 25 are arranged orthogonally with respect to the diagonals of the square of plastic material so as to divide the square into segments consisting of equal right isosceles triangles at each of the corners 15, 17, 19 and 21 and an interior segment 33 within the square formed by the four squares of parallel grooves 23 and 25. As shown, the distance from the vertex of each of the corners 15, 17, 19 and 21 to the outermost groove 23 is less than the distance from the innermost groove 25 to the center 35 of the square of material. In any configuration in which the game board is to be symmetrically folded, the distance from the vertex of the corner to the zenith 31 associated therewith cannot be greater than the distance from the zenith 31 to the center 35 of the square.

In the preferred embodiment shown, each of the corner segments is provided with a pair of ridges 41 and 43 confining surfaces 45 and 47 lying in nonparallel planes perpendicular to the upper face 11. The interior segment 33 is also provided with pairs of ridges 51 and 53 defining another set of surfaces 55 and 57 in non-parallel planes perpendicular to the top face 11. Each pair of corner ridges 41 and 43 are aligned with corresponding pairs of inner segment ridges 51 and 53 so that when the corners are folded toward the center of the square, corresponding sidewall or nonparallel surfaces 45 and 55 and 47 and 57 will engage in a frictional interface so as to hold the folded corner in juxtaposition with the inner segment. As shown, the angle between the nonparallel surfaces 45 and 47 and the nonparallel surfaces 55 and 57 is approximately forty to forty-five degrees and is symmetrically arranged in relation to the diagonals of the square. This configuration is preferred since the angular relationship of forces normal to these planes provides a satisfactory frictional grip. However, satisfactory frictional grip could also be achieved by use of a single ridge on each corner extending parallel to the base of the corner with corresponding ridges on the interior segment 33. Any number and alignment of ridges providing acceptable frictional force could be employed. For game boards other than the square board illustrated to be folded symmetrically about the center of the board, mating ridges on opposite sides of the zenith 31 separating segments of the board will permit the board to be secured in its folded condition.

Figure 4:
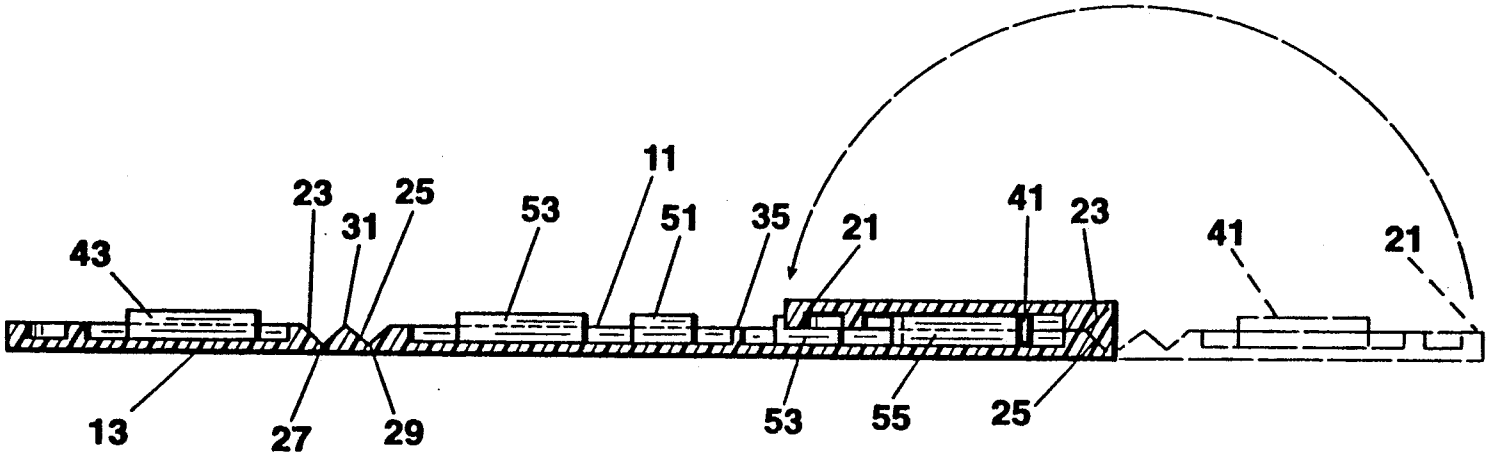
FIG. 4 is a cross-sectional view taken diagonally through the game board of FIG. 1 with one of its corners in the folded condition.

As shown, each of the grooves 23 and 25 is formed at an angle of ninety degrees with respect to its nadir 27 and 29, this results in the optimal condition of permitting a 180° fold while still permitting the groove surfaces to abut with each other so as to exert a force on the folded segment which in turn causes the ridges of the folded segment to exert a normal force against its mating frictional surface. This is best seen in FIG. 4 which shows the right corner 21 in the folded condition so that the surfaces of the grooves 23 and 25 are in contact with each other when the frictional surfaces are interfaced. Of course, the grooves need not each be ninety degrees but must total at least 180° to permit the necessary fold. While the grooves 23 and 25 may be of the same depth, it is preferable that the depth to the innermost nadir 29 be shallower than the depth to the outermost nadir 27 to maximize the normal force and minimize the vertical force on the frictional interface surfaces.

Also as shown, the preferred embodiment of the game board will include one or more recesses 61 and 63 surrounding the respective ridges 41 and 43 and the interior segment 33 one or more recesses 65 surrounding the interior ridges 51 and 53 so as to reduce the amount of plastic used in the manufacture of the game board and further to increase the frictional interface area provided by the mating surfaces.

Preferably, the board will be integrally formed of injection molded plastic, the composition designed not to deteriorate with repeated folding and unfolding. A plastic such as a copolymer of polypropylene available from Himont is an example of a suitable material.

Thus, it is apparent that there has been provided, in accordance with the invention, a game board that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A game board comprising a unitary thin plastic member having a face with a pair of parallel grooves therein having nadirs separated by a zenith therebetween dividing said member into first and second segments, said first segment having a plurality of first ridges having side wall surfaces in non-parallel planes perpendicular to said face and said second segment having a plurality of second ridges having sidewall surfaces in non-parallel planes perpendicular to said face, said side wall surfaces of said first and second ridges being aligned such when said segments are folded at said nadirs into juxtaposition with each other, the side wall surfaces of said first and second ridges abut for frictional interface therebetween.

2. A game board according to claim 1, one of said nadirs being shallower than another of said nadirs.

3. A game board comprising a unitary thin plastic square having a face with innermost and outermost arrays of grooves orthogonal to the diagonals of said square therein defining equal right isosceles corners on said square, said innermost and outermost grooves having angles at nadirs thereof totalling at least 180 degrees and the distance from a vertex of each of said corners to a zenith between its respective nadirs being not greater than the distance from said zenith to a center of said square.

4. A game board according to claim 3, each of said angles being approximately 90 degrees.

5. A game board according to claim 3, said distances being equal.

6. A game board according to claim 3, each of said corners having a plurality of first ridges having side wall surfaces in non-parallel planes perpendicular to said face and an inner portion of said face bounded by said innermost array of grooves having a plurality of second ridges having sidewall surfaces in non-parallel planes perpendicular to said face, said sidewall surfaces of said first and second ridges being aligned such that when said corners are folded at their respective said nadirs into juxtaposition with said inner portion of said face, the side wall surfaces of said first and second ridges abut for frictional interface therebetween.

7. A game board according to claim 3, each of said corners having a first ridge thereon having a surface perpendicular to said face and an inner portion of said face bounded by said innermost array of grooves having four second ridges having side wall surfaces perpendicular to said side wall surfaces of said face, said first and second ridges being aligned such that when said corners are folded at their respective said nadirs into juxtaposition with said inner portion of said face, the side wall surfaces of said first and second ridges abut for frictional interface therebetween.

8. A game board according to claim 4, said square having a smooth face opposite said grooved face.

9. A game board according to claim 3, said innermost of said nadirs being shallower than said outermost of said nadirs.

* * * * *